US009555938B2

(12) United States Patent
Syrkos

(10) Patent No.: US 9,555,938 B2
(45) Date of Patent: Jan. 31, 2017

(54) LIQUID CONTAINER

(75) Inventor: Yves Syrkos, Blainville (CA)

(73) Assignee: QUEBEC INC./SYRKOSS, Blainville, Québec (CA)

( * ) Notice: Subject to any disclaimer, the term of this patent is extended or adjusted under 35 U.S.C. 154(b) by 683 days.

(21) Appl. No.: 12/385,325

(22) Filed: Apr. 6, 2009

(65) Prior Publication Data

US 2009/0250461 A1 Oct. 8, 2009

Related U.S. Application Data

(60) Provisional application No. 61/064,945, filed on Apr. 4, 2008.

(51) Int. Cl.
*B65D 51/18* (2006.01)
*B65D 47/24* (2006.01)
*A47G 19/22* (2006.01)

(52) U.S. Cl.
CPC ..... *B65D 47/248* (2013.01); *A47G 19/2272* (2013.01)

(58) Field of Classification Search
CPC ..... B65D 47/248
USPC ..... 220/240, 719, 254.1, 256.1, 711,220/714–715, 281, 254.7; 215/387, 201, 211, 215/213, 801, 804, 325, 216
See application file for complete search history.

(56) References Cited

U.S. PATENT DOCUMENTS 4,138,033 A * 2/1979 Payne et al. ..... 220/254.3
4,361,249 A * 11/1982 Tuneski et al. ..... 220/254.3
5,564,480 A * 10/1996 Chen ..... 141/65
5,692,632 A * 12/1997 Hsieh et al. ..... 220/212
5,692,633 A * 12/1997 Gordon ..... 220/253
5,706,972 A * 1/1998 Sousa ..... 220/714
5,810,189 A * 9/1998 Baker ..... 220/257.2
5,890,619 A 4/1999 Belanger
6,003,711 A * 12/1999 Bilewitz ..... 220/253
6,202,877 B1 * 3/2001 La Torre et al. ..... 220/254.1
7,011,221 B2 3/2006 Smith et al.
7,537,133 B2 * 5/2009 Naesje ..... 220/714
7,686,182 B1 * 3/2010 Shukri ..... 220/711
2004/0144792 A1 * 7/2004 Naesje ..... 220/714
2005/0067417 A1 3/2005 Sanders et al.
2005/0167437 A1 8/2005 Struckmeier
2005/0184075 A1 8/2005 Belcastro
2005/0224495 A1 10/2005 Kartinian

* cited by examiner

*Primary Examiner* — Anthony Stashick
*Assistant Examiner* — Robert Poon
(74) *Attorney, Agent, or Firm* — Equinox IP

(57) ABSTRACT

A cover for a liquid container having a body for holding a liquid and defining a body aperture has a mobile member connectable to a fixed structure relative to the aperture via a resilient outer membrane connected thereto, and an inner closing structure mountable in the body proximal the aperture and connected to the mobile member. The inner closing structure is movable, by application of an inwardly directed force to the mobile member, from a first configuration for the cover, in which the inner closing structure impedes passage of the liquid through the aperture, into a second configuration in which at least a portion of the aperture is unblocked and the liquid may flow therearound and out of the aperture for removal from the container. The membrane biases the inner closing structure and the mobile member into the first configuration for the cover.

15 Claims, 10 Drawing Sheets

LIQUID CONTAINER

CROSS REFERENCE TO RELATED APPLICATION

Benefit of U.S. Provisional Application for Patent Ser. No. 61/064,945 filed on Apr. 4, 2008, is hereby claimed.

FIELD OF THE INVENTION

The present invention relates to containers, and is more directly concerned with a liquid container for storing liquid and the cover therefor.

BACKGROUND OF THE INVENTION

It is well known in the art to use containers, for example glasses or cups, for storing liquid for drinking. Such containers allow transport of the liquid for concurrent or subsequent use or consumption, such as drinking, thereof. Typically, consumption or use of the liquid occurs by removing liquid from the container through an aperture thereof, typically situated at a first top end of the container. In order to reduce risk of spillage of the liquid, such containers often have covers disposed thereon and which cover the aperture. However, such covers must often, inconveniently, be removed to allow use or consumption of the liquid. Alternatively, other covers may remain engaged in the aperture and provide a cover aperture through which the liquid may be removed from the container while the cover continues to seal the aperture. Unfortunately, such covers often limit removal of the liquid to the cover aperture, which, for drinking or removal of the liquid into another container, requires, inconveniently, that the container be precisely positioned with the cover aperture situated proximal the lips of the user or near the other container to reduce risk of spillage. Further, there may be a risk of spillage through the cover aperture, if no sealing mechanism therefore is provided, if the container is upset.

Accordingly, there is a need for an improved liquid container with a simple configuration and the cover therefor.

SUMMARY OF THE INVENTION

It is therefore a general object of the present invention to provide an improved liquid container and the cover therefor.

An advantage of the present invention is that the cover of the liquid container provided thereby prevents spillage of the liquid stored therein, even in case of upset of the container, and the liquid is allowed to escape the container, via its cover, when a small pressure is locally applied thereon; the cover automatically returns to a sealing configuration when the pressure is removed.

Another advantage of the present invention is that the liquid stored in the container may be easily removed and drunk from the container, via its cover, with a minimum risk of spillage.

A further advantage of the present invention is that the liquid stored in the container may be removed or drunk from a variety of positions.

Yet another advantage of the present invention is that the cover of the liquid container can be locked when in the sealing configuration in order to remain in that configuration.

According to an aspect of the present invention, there is provided a cover for a liquid container having a body for holding a liquid and defining a body aperture, said cover comprising:

a rigid mobile member connecting all around to a rigid fixed member via a resilient membrane connected thereto, the fixed member being removably mountable on the body adjacent the body aperture and having a lower edge; and an inner closing structure mountable proximal the body aperture and fixedly connected to the mobile member, the inner closing structure, by a local application of an inwardly directed force over only a portion of the mobile member, being locally movable from a first configuration for the cover, in which the inner closing structure impedes passage of the liquid through the body aperture, into a second configuration in which a portion of the body aperture is unblocked with a portion of the inner closing structure moving away from the lower edge and the liquid may flow therearound and out of the body aperture for removal from the container, while a remaining portion of the inner closing structure remains into the first configuration, the inner closing structure being spaced from the resilient membrane along the mobile member and being adapted to be inwardly positioned toward the liquid container relative to the resilient membrane with the resilient membrane connecting to the mobile member at a location between the inner closing structure and the mobile member on which the inwardly directed force is applied, the resilient membrane allowing local inward displacement of the portion of the mobile member relative to the fixed member upon the local application of the inwardly directed force and biasing the inner closing structure and the mobile member into the first configuration for the cover.

Conveniently, the fixed structure is a fixed member removably mountable on the body adjacent the body aperture, the outer membrane connecting to the mobile member and to the fixed member and extending therebetween for relative movement of the mobile member relative to the fixed member.

Optionally, the cover further includes a locking mechanism to lock the cover into the first configuration, the locking mechanism connecting to both the mobile member and the fixed member.

According to another aspect of the present invention, there is provided a liquid container comprising a body for holding a liquid and defining a body aperture; and a cover as above-claimed removably mounting on the body adjacent the body aperture.

According to another aspect of the present invention, there is provided a cover for a liquid container having a body for holding a liquid and defining a body aperture, the cover comprising:

a cover body comprising means for retaining the cover onto the container and a rigid fixed cover member defining cover aperture with circumferential openings, the fixed cover member having a bottom peripheral surface defining a lower edge;

a rigid mobile member having only a portion on which a user can locally apply pressure;

an inner closing structure fixedly connecting to the mobile member, a portion of the inner closing structure being locally movable from a first configuration wherein the cover aperture is closed to prevent discharge of the liquid contained in the container through the circumferential openings to a second configuration wherein the cover aperture is locally open to allow discharge of the liquid through the circumferential openings, while a remaining portion of the inner closing structure remains in the first configuration; and a resilient membrane mounted on the mobile member and defining a diaphragm between the fixed cover member and the mobile member, the mobile member being responsive to the pressure of the user such that the inner closing structure is locally movable from the first configuration, wherein the inner closing structure abuts against the lower edge for impeding passage of the liquid through the cover aperture and the resilient membrane biases the inner closing structure against the cover aperture when the pressure is no longer applied on the portion of the mobile member, to the second configuration, wherein the resilient membrane allows local displacement of a portion of the inner closing structure relative to the lower edge upon local application of the pressure on the portion of the mobile member and the portion of the inner closing structure no longer abuts against the lower edge for locally allowing passage of the liquid in the cover aperture.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 5:
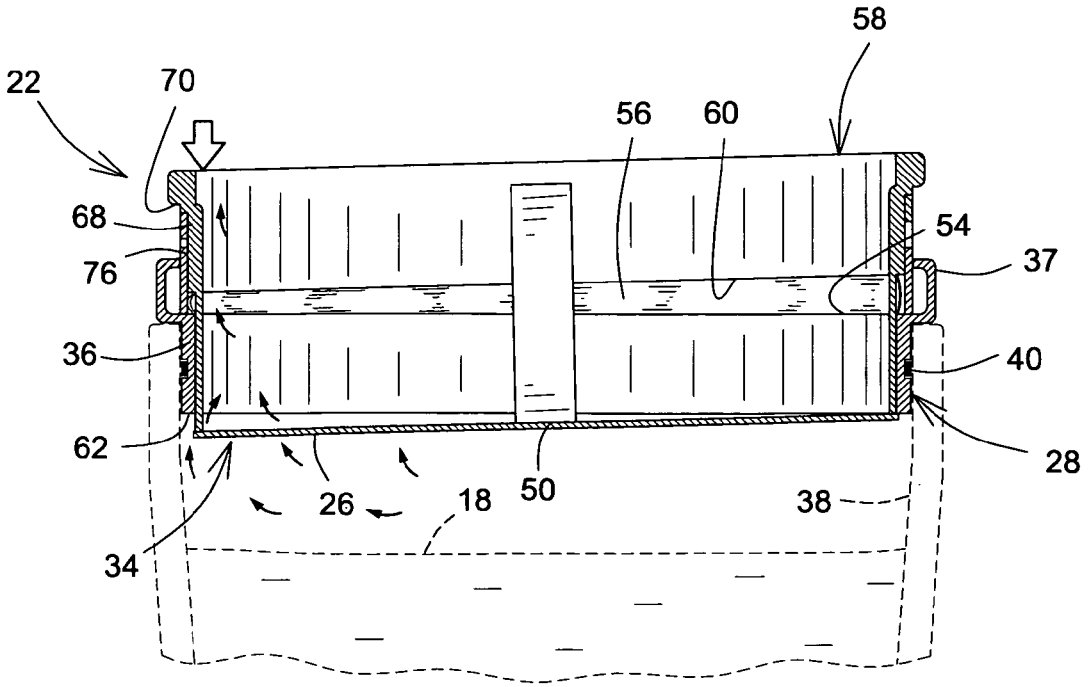
FIG. 5 is a sectional view of the container shown in FIG. 1, taken along line 4-4 of FIG. 1 and illustrating second configuration shown in FIG. 3.
Figure 6:
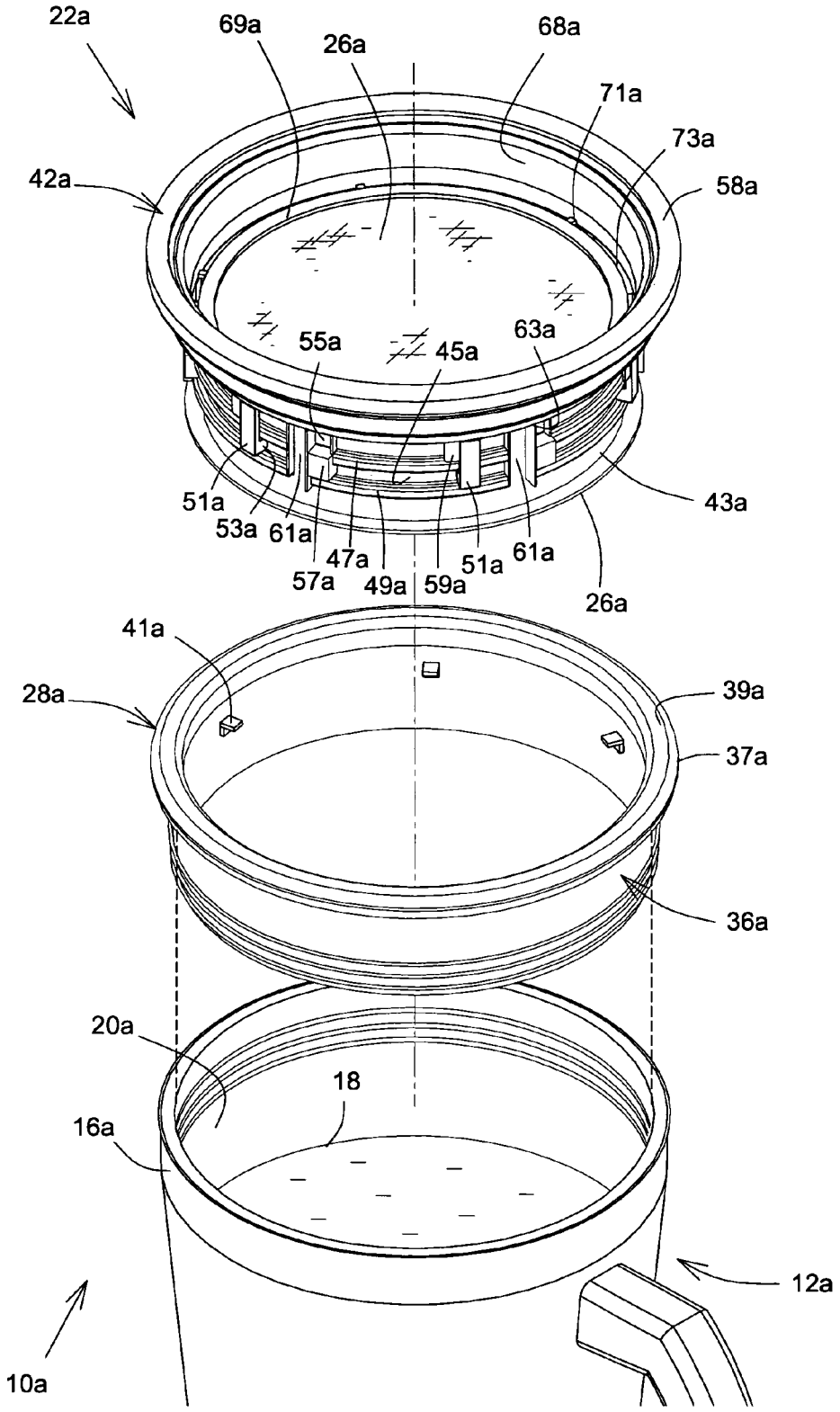
FIG. 6 is an exploded top perspective view of a second embodiment of a liquid container in accordance with the present invention.

Referring to FIGS. 1, 2, 3, 4, and 5, there is schematically shown an embodiment of a container, shown generally as 10, in accordance with the present invention. For all of the embodiments, the container 10 has a hollow body, shown generally as 12, in which a liquid 18 is placed, having a closed bottom body end 12 and a generally opposed open top body end 14 having a body aperture 20 disposed therein. A cover, shown generally as 22, is disposed across, and partially in, the body aperture 20 and includes an inner closing structure 26 mounted or connected by at least one mobile member 42, itself connected to a fixed cover member 28 removably mounted on the body 12 adjacent the aperture 20, relative to the body 12, via a resilient outer membrane 56, the closing structure 26 extending within the body proximal the body aperture 20. The inner closing structure 26 is movable by application of a downwardly directed force to the cover 22, and more particularly to the mobile member 42, from a first configuration, shown generally as 32 in FIG. 4, into a second configuration, shown generally as 34 in FIG. 5. The downwardly directed force, shown by the large arrow in FIG. 5, is directed towards the bottom body end 14. In general, the inner closing structure 26, for example a membrane, inner cover, or the like, is sized and shaped to extend across the body aperture 20 and abut a fixed structure, relative to the body 12, such as the fixed cover member 28 or directly inner body walls 38 or ridges 135 defining the aperture 20 to stop or block the flow of liquid 18 in the first configuration 32. Further, the inner closing structure 26 is preferably resilient at least at the extremity or perimeter thereof, or may have a resilient structure, such as a sealing ring (not shown), mounted on the extremity or perimeter thereof, to facilitate sealing abutment thereof with the fixed structure as fixed cover member 28 for the first configuration 32.

In the first configuration 32, the body aperture 20 is sealed by the cover 22 and the inner closing structure 26 which prevents passage of the liquid 18 through the body aperture 20. In the second configuration 34, the closing structure 26 is at least partially disengaged from the body aperture 20 by application of the downwardly directed force, thus uncovering and unsealing the body aperture 20. Accordingly, in the second configuration 34 the liquid 18 may pass around the inner closing structure 26 and through a portion of the body aperture 20 for removal from the container 10 through the cover 22. When the downwardly directed force is removed, the inner closing structure 26 is biased back into the first configuration 32 by the resilient action of the outer membrane 56. Specifically, in the absence of the force, the outer membrane 56 resiliently biases away from the bottom body end 14, along with the member 42 and inner closing structure 26 connected thereto until the inner closing structure 26 blockingly and sealingly extends across the aperture 20 within the body 12 and blocks passage of the liquid 18 therethrough. The covers 22*a*, 22', 22" and 22*a*" for the containers 10*a*, 10', 10" and 10*a*" shown respectively in FIGS. 6, 11, 13 and 15 are similar in function.

Figure 1:
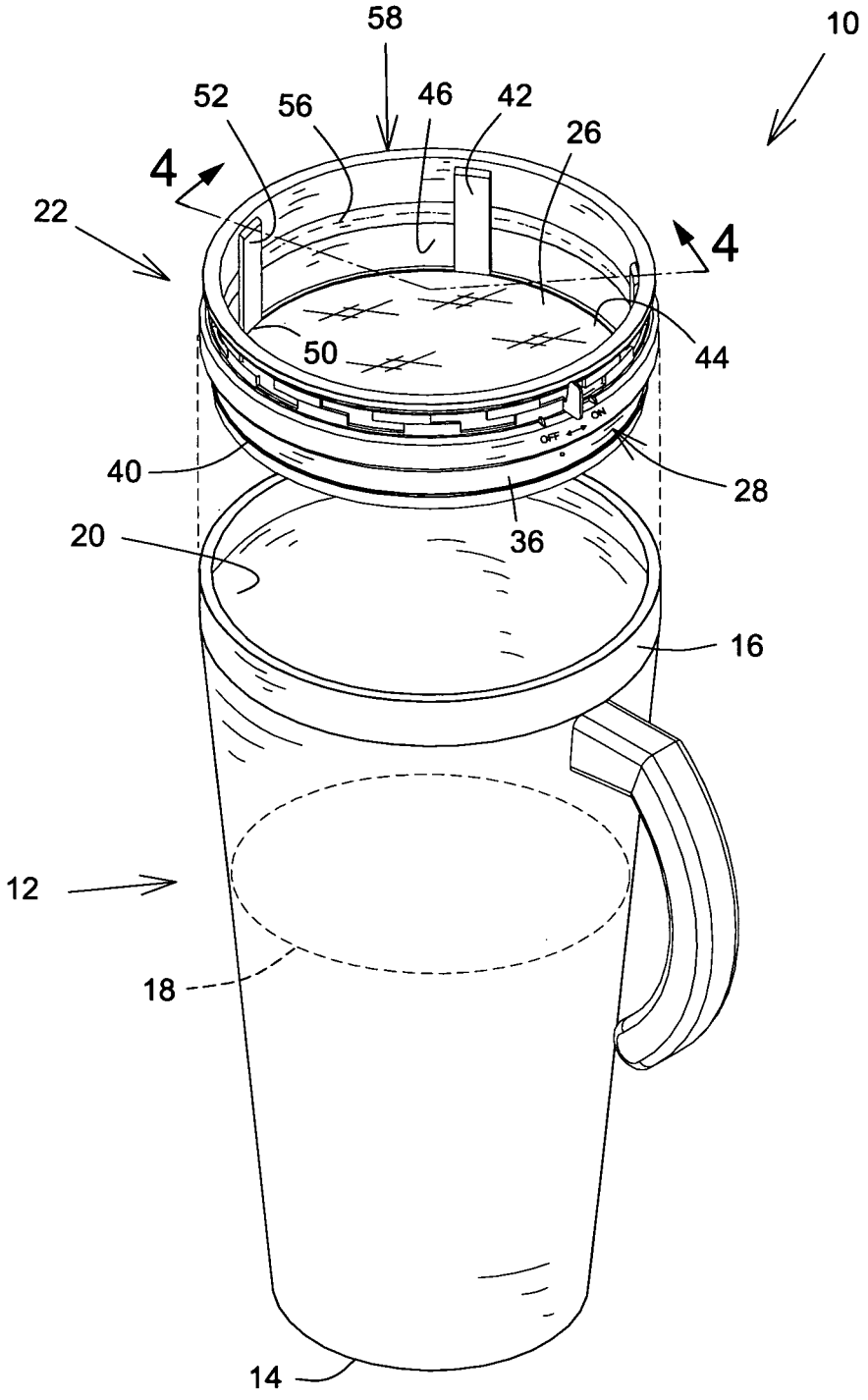
FIG. 1 is a perspective view of an embodiment of a liquid container in accordance with the present invention.

To aid the reader in better understanding the first embodiment, the specific features of the container 10 shown in FIGS. 1 through 5 are now explained. As shown in FIG. 1, the inner closing structure 26 is resiliently mounted in the cover 22 to the fixed cover member 28 which has a lower cover wall 36 configured, for example sized and shaped, for abutting against the inner body wall 38 which extends from the top body end 16 to the bottom body end 14 and which defines the body aperture 20 at the top body end 16. A radially outwardly protruding cover lip 37, which protrudes outwardly from the lower cover wall 36 of the fixed member 28 and extends therearound, generally abuts against an edge of the top body end 16. The lower cover wall 36, in conjunction with a sealing ring 40 disposed thereon, sealingly abut against the inner body wall 38 and prevent flow of the liquid therebetween when the cover 22 is inserted into the body 12 at aperture 20. The inner closing structure 26, impermeable to the liquid 18, is sized and shaped to extend across and cover a cover aperture 44 defined by the inner cover wall surface 46 of the lower cover wall 36. Thus, when the cover 22 is inserted into the body 12, and specifically the body aperture 20, the liquid may only be released through the cover aperture 44.

The inner closing structure 26 is resiliently mounted in the cover 22 to the fixed cover member 28 by at least one member 42, and preferably a plurality of members 42, the inner closing structure 26 being connected on an outer perimeter thereof to a first lower member end 50 of each member 42. The second upper member end 52 of each member 42 is connected to a top 58 resiliently mounted overlaying an upper edge 54 of the lower cover wall 36 by the resilient outer membrane 56 which extends between and connects the top 58 to the upper edge 54. More specifically, the top 58 is sized and shaped such that a lower top end or edge 60 thereof overlays the upper edge 54 which prevents passage of the top beyond the upper edge 54, by abutment therewith, when the top 58 is moved toward the upper edge 54. The upper membrane 56, which extends between and connects the upper edge 54 and lower top edge 60, biases the top 58 upwardly away from the upper edge 54 and the inner closing structure 26 connected to the top 58 by members 42 upwardly towards the lower edge 62 of the lower cover wall 36. Specifically, in the absence of any downwardly directed force on the top 58, the outer membrane 56 biases the inner closing structure 26 into the first configuration 32 of the cover 22, in which the inner closing structure 26 is pulled, by resilient biasing of the outer membrane on the members 42, sealingly across the cover aperture 44 and into abutment the lower edge 62, thus sealing the cover aperture 44 and preventing flow of liquid 18 therethrough. As passage of the liquid 18 between walls 36, 38 is also sealingly blocked, when the cover 22 is in the first configuration 32, the body aperture 20, including cover aperture 44, is sealed. Exertion of a downwardly directed force, shown by the large arrow in FIG. 5, on the top 58 such that at least one member 42 is moved downwardly, causes the inner closing structure 26 to be locally moved downwardly away from the lower edge 62 and lower cover wall 36. Thus, the cover 22 is placed in the second configuration in which at least a portion of the inner closing structure 26 is separated from the lower edge 62 and wall 36, which creates a space therebetween through which the liquid 18 may flow from the body 12 through the body aperture 20 and cover aperture 44 out of the container 10, thus unsealing the apertures 20, 44. Once the force is removed, the outer membrane 56 biases the members 42 upwardly and brings the inner closing structure 26 back into sealing abutment with the lower edge 62 and extension across the cover aperture 44, thus placing the cover 22 back into the first configuration 32.

The members 42 are preferably substantially equally spaced apart one another, which, advantageously allows placement of the cover 22 in the second configuration 34 for removal of liquid 18 through the apertures 20, 44 by applying sufficient downwardly directed force to any portion of the top 58. Thus, conveniently, a user may press any portion of the top to release the liquid 18 while placing the user's lips, if desired, on any portion of top 58 to drink the liquid 18 released.

Optionally, and as shown in FIGS. 1 through 5, the cover 22 may also have a locking mechanism to lock the cover 22 in the first configuration (therefore prevent the mobile member 42 from moving relative to the fixed cover member 28) which may include optional upper and lower locking rings or bands 64, 66 respectively. The upper locking band 64 is fixedly attached to the top 58 (or alternatively integral therewith) and extends proximally around an outer top wall 68 thereof in abutment with a protruding top rim 70 of the top 58. The lower locking band 64 is freely rotatably mounted around the outer top wall 68 of the fixed cover member 28 between the upper locking band 64 and an outer support wall or protrusion 76 which extends therefrom to the lower cover wall 36. Each locking band 64, 66 has a series of spaced apart band slots 80 which are alternately spaced apart from one another with tabs or other solid portions 82 disposed therebetween. The tabs 82 and slots 80 are configured, for example sized and shaped, such that the tabs 82 of one band 64, 66 can fit, i.e. be received, into the slots 80 of the other band 64, 66 when the slots 80 of one band 64, 66 are aligned, without overlap of the tabs 82, with the tabs 82 of the other band 64, 66 and the downwardly directed force is applied to the top 58. Such alignment is achieved by rotation or turning of the lower band 66.

Otherwise, the respective tabs 82 of each of each band 64, 66 at least partially overlap one another and will abut against one another during application of the downwardly directed force, preventing movement of the members 42 downward and separation of the inner from the lower cover wall 36 and placement of the cover 22 in the second configuration 34. Accordingly, when the cover is in the first configuration 32, at least a portion of the respective tabs 82 of the bands 64, 66 overlap one another, preferably each tab 82 of the upper band 64 completely overlaying a tab 82 of the lower band 82, and locks the cover 22 in the first configuration 32. To place the cover 22 in the second configuration 34, the lower band 66 is turned or rotated to bring the tabs 82 of each band 64, 66 into alignment with the slots 80 of the other band 64, 66, without overlap of the tabs 82, which enables passage of the tabs 82 into the slots 80. Thus, the cover 22 is unlocked and the downwardly directed force applied on the top 58 can separate the inner closing structure 26 from the lower cover wall 36, as described previously. When the force on the top 58 is released, the lower band 66 can be rotated to place the tabs 82 in at least partial overlap with one another, once again locking the cover 22 in the first configuration 32.

Figure 2:
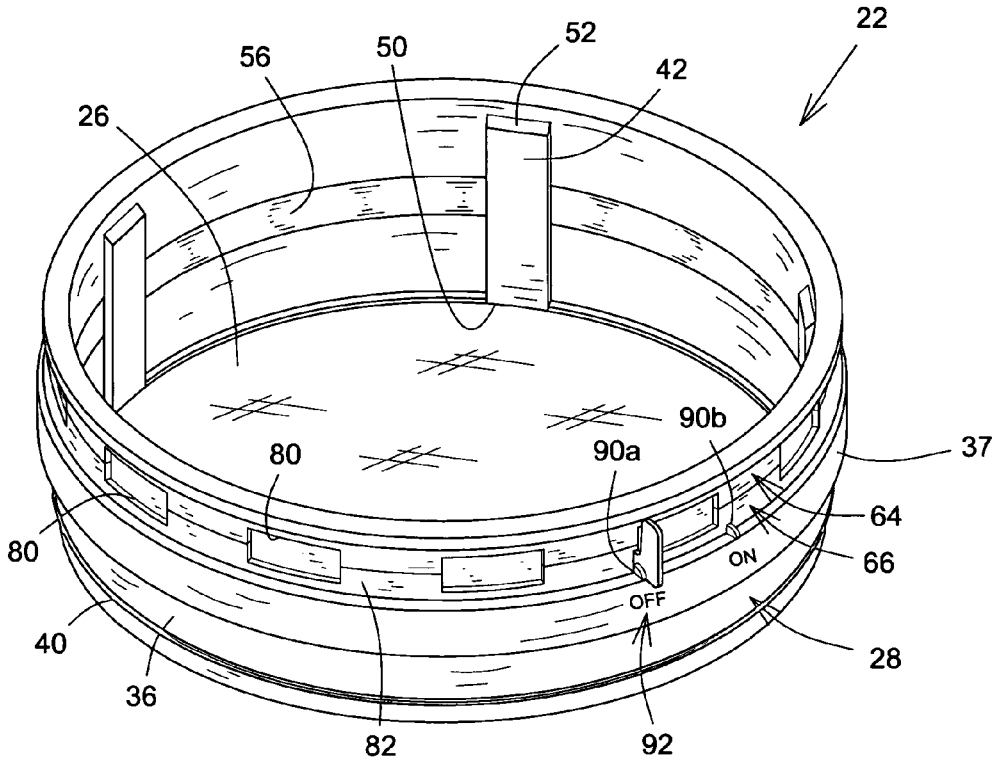
FIG. 2 is a perspective view of a cover for the container shown in FIG. 1 in a first configuration.
Figure 3:
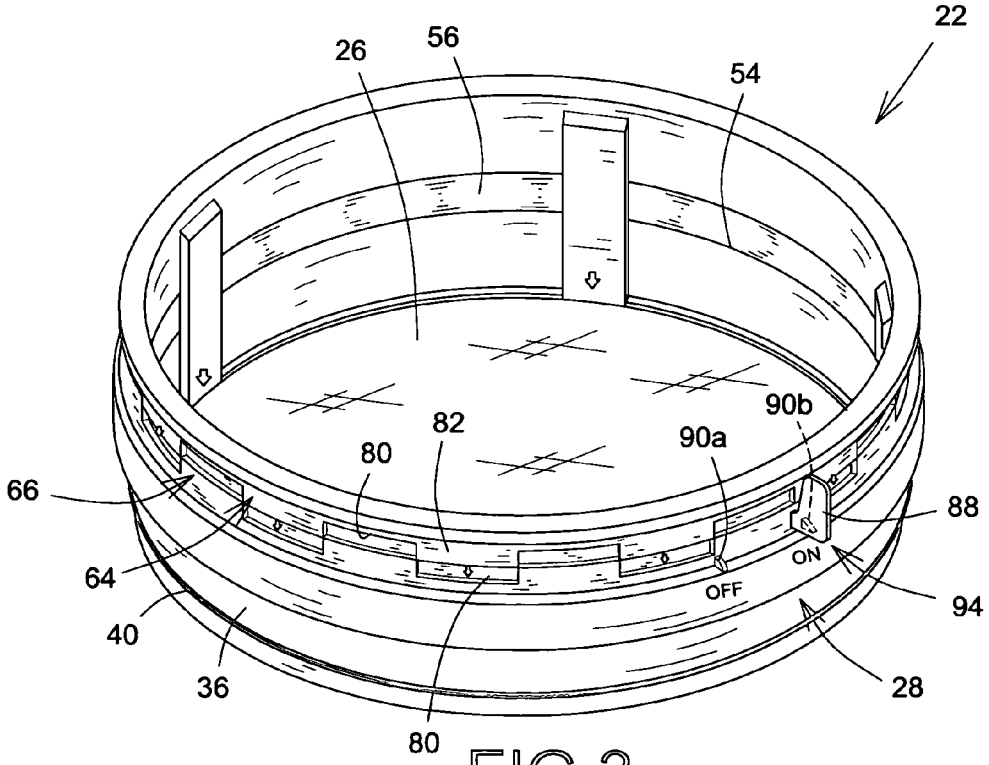
FIG. 3 is a perspective view of a cover for the container shown in FIG. 1 in a second configuration.
Figure 4:
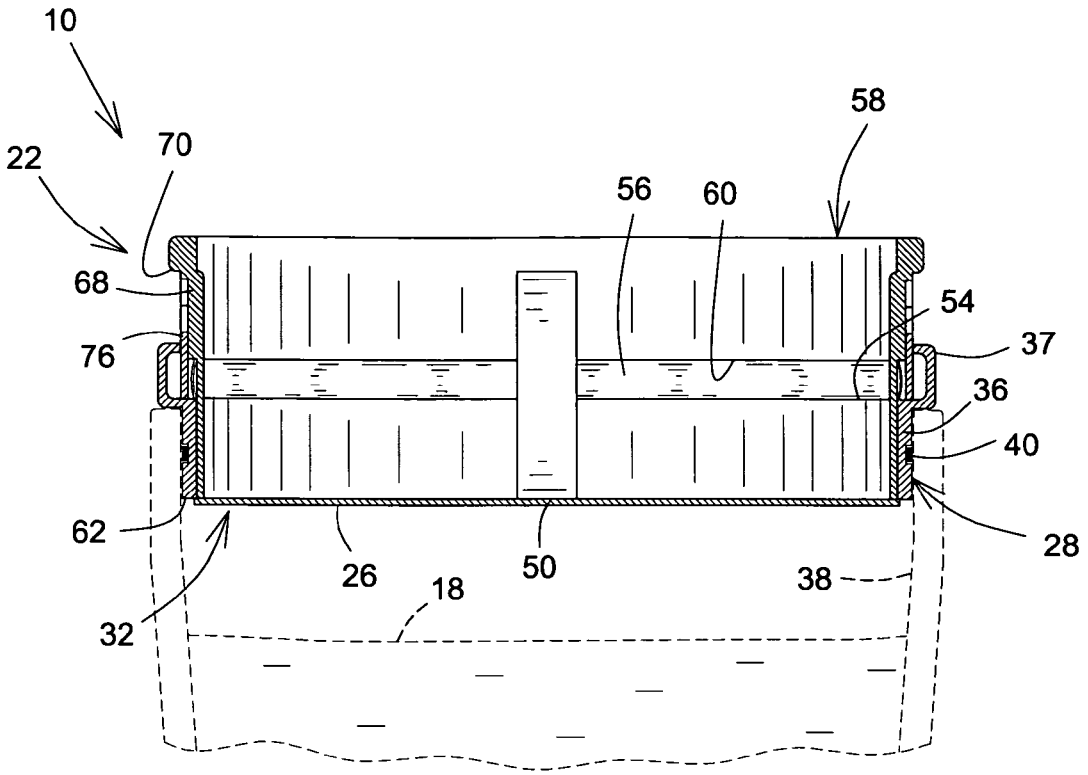
FIG. 4 is a sectional view of the container shown in FIG. 1, taken along line 4-4 of FIG. 1 and illustrating the first configuration shown in FIG. 2.

To facilitate turning of the lower band 66, an optional guide protrusion or finger 88 is, optionally, disposed on one of the tabs 82 of the lower band 66 and protrudes outwardly therefrom, thus enabling a user to rotate the lower band 66 by applying force or pressure to the finger 88. To further facilitate correct alignment of the tabs 82 of each band 64, 66 with the slots 80 of the other band 64, 66, the finger 88 may be disposed between first and second stops 90*a*, 90*b* which block the finger 88 during rotation of the lower band 66, thus limiting the range of movement of the lower band 66. Specifically, the first stop 90*a* is positioned such that when the finger 88 abuts thereagainst, in a locking position 92 for the first configuration 32, the tabs 82 of the bands 64, 66 at least partially overlap one another, preventing placement of the cover 22 in the second configuration 34, as shown in FIG. 2. The second stop 90*b* is positioned such that, when the finger 88 abuts thereagainst, in an unlocking position 94 for the second configuration 94, the slots 80 of each band 64, 66 are aligned with the tabs of the other band 64, 66, as shown in FIG. 3. Thus, by simply moving the finger between abutment with the first stop 90*a* and abutment with second stop 90*b*, a user may lock and unlock the cover 22 for placement thereof in the first and second configurations 32, 34. It should be noted that, if desired, the lower band 66 could be fixedly attached to the cover 22 and the upper band 64 movable, in which case the finger 88 would be situated on the upper band 64.

Referring now to FIGS. 6 to 10, therein is shown a container 10*a* in accordance with a second embodiment of the present invention. As with the first embodiment, the container 10*a* has a body 12*a* and cover 22*a*. The body 12*a* has a body aperture 20*a* at the body top end 16*a* situated opposite a closed body bottom end (not shown). The cover 22*a* is removably connected to the body 12*a* via a fixed cover member 28*a*. Specifically, the fixed cover member 28*a* typically has threads protruding from an outer wall surface of a lower cover wall 36*a* for engagement, preferably sealingly, with corresponding inner threads on the body top end 16*a*. A radially outwardly protruding cover lip 37*a*, which protrudes outwardly from the lower cover wall 36*a* of the fixed member 28*a* and extends therearound, generally abuts against an edge of the body top end 16*a*.

Figure 10:
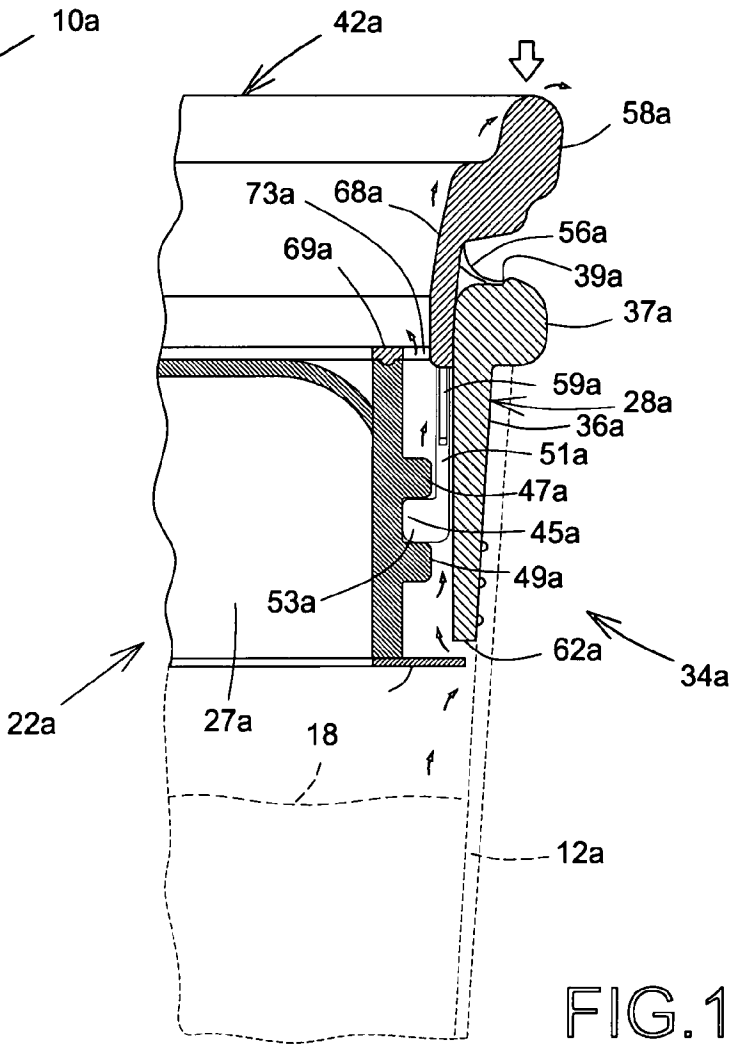
FIG. 10 is a sectional view of the container shown in FIG. 6, taken along line 9-9 of FIG. 8 and illustrating second configuration shown in FIG. 8.

The inner closing structure 26*a* includes a lower wall 43*a* extending axially upwardly therefrom that has a channel 45*a* formed therein and defined by upper 47*a* and lower 49*a* parallel ridges extending outwardly and circumferentially to slidably receive therein a radially inwardly protruding finger lip 53*a* of at least one, preferably six, circumferentially equally spaced fingers 51*a*. The fingers 51*a* extend axially downwardly from an upper top wall 68*a* of the mobile member 42*a*, and are typically snappingly inserted into their respective portion of the channel 45*a* as long as they are made out of a material flexible enough for such an insertion. When the fingers 51*a* are in their respective portion of the channel 45*a*, the upper wall 68*a*, which is allowed to circumferentially rotate relative to the lower wall 43 about a cover axis, has an inner ring 69*a* or the like, adapted to abuttingly sit on the lower wall 43*a*, spaced therefrom via a plurality of circumferentially spaced ring connectors 71*a* defining circumferential openings 73*a* there between. The lower wall 43*a* and ridges 47*a*, 49*a* of the mobile member 42*a* are radially inwardly spaced from the lower cover wall 36*a* of the fixed member 28*a* and also from the upper wall 68*a* to allow liquid 18 to flow there between, and between the fingers 51*a* and through the openings 73*a*, when the cover 22*a* is in the second configuration 34*a* (as shown in FIG. 10). The resilient outer membrane 56*a* typically depends from the top outer lip 58*a* protruding radially outwardly from the upper wall 68*a* to abutingly connect to the cover lip 37*a*, as better shown in FIGS. 9 and 10. The cover lip 37*a* typically includes a step 39*a* formed therein to abuttingly receive and constrain the displacement of the outer membrane 56*a* there against when the cover 22*a* is in the second configuration 34*a* shown in FIG. 10, to render more efficient the biasing action of the outer membrane 56*a* onto the inner closing structure 26*a* and the mobile member 42*a*.

When exerting a downwardly directed force, shown by the large arrow in FIG. 10, on the top outer lip 58*a*, the lips 53*a* of the respective fingers 51*a* abut against the lower ridge 49*a* to lower the inner closing structure 26*a* relative the fixed member 28*a*, and allow at least a portion of the typically flexible outer perimeter of the inner structure 26*a* to separate from the lower edge 62*a* of lower cover wall 36*a*, which creates a space there between through which the liquid 18 may flow from the body 12*a* through the body aperture 20*a*, the openings 73*a* and cover aperture 44*a* out of the container 10*a*. Once the force is removed, the outer membrane 56*a* biases the fingers 51*a* upwardly which have their respective lips 53*a* abutting against the upper ridge 47*a* and bring the inner closing structure 26*a* back into sealing abutment with the lower edge 62*a* and extension across the cover aperture 44*a*, thus placing the cover 22*a* back into the first configuration 32*a* shown in FIG. 9.

Figure 7:
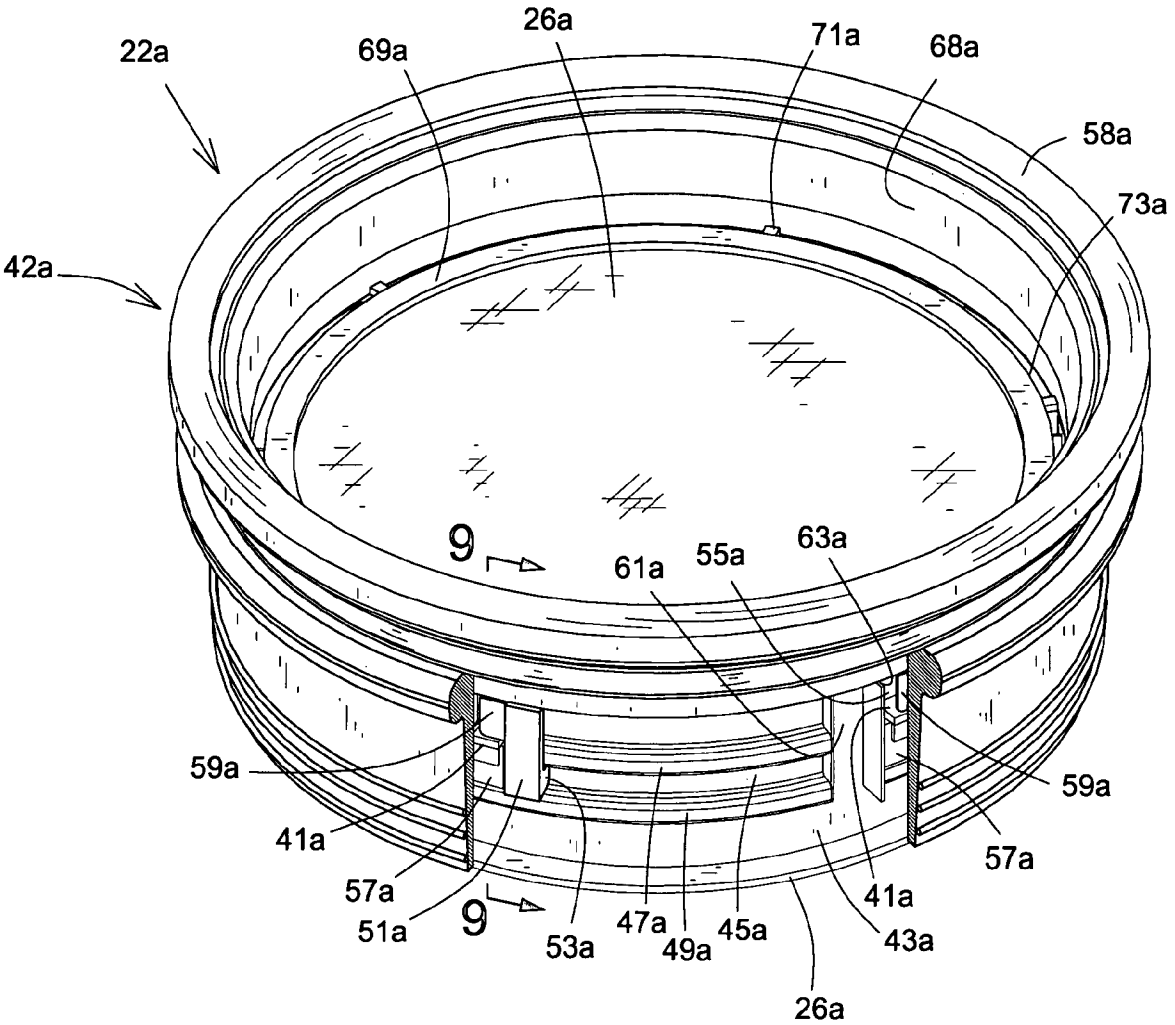
FIG. 7 is a perspective view of a cover for the container shown in FIG. 6 in a first configuration.
Figure 8:
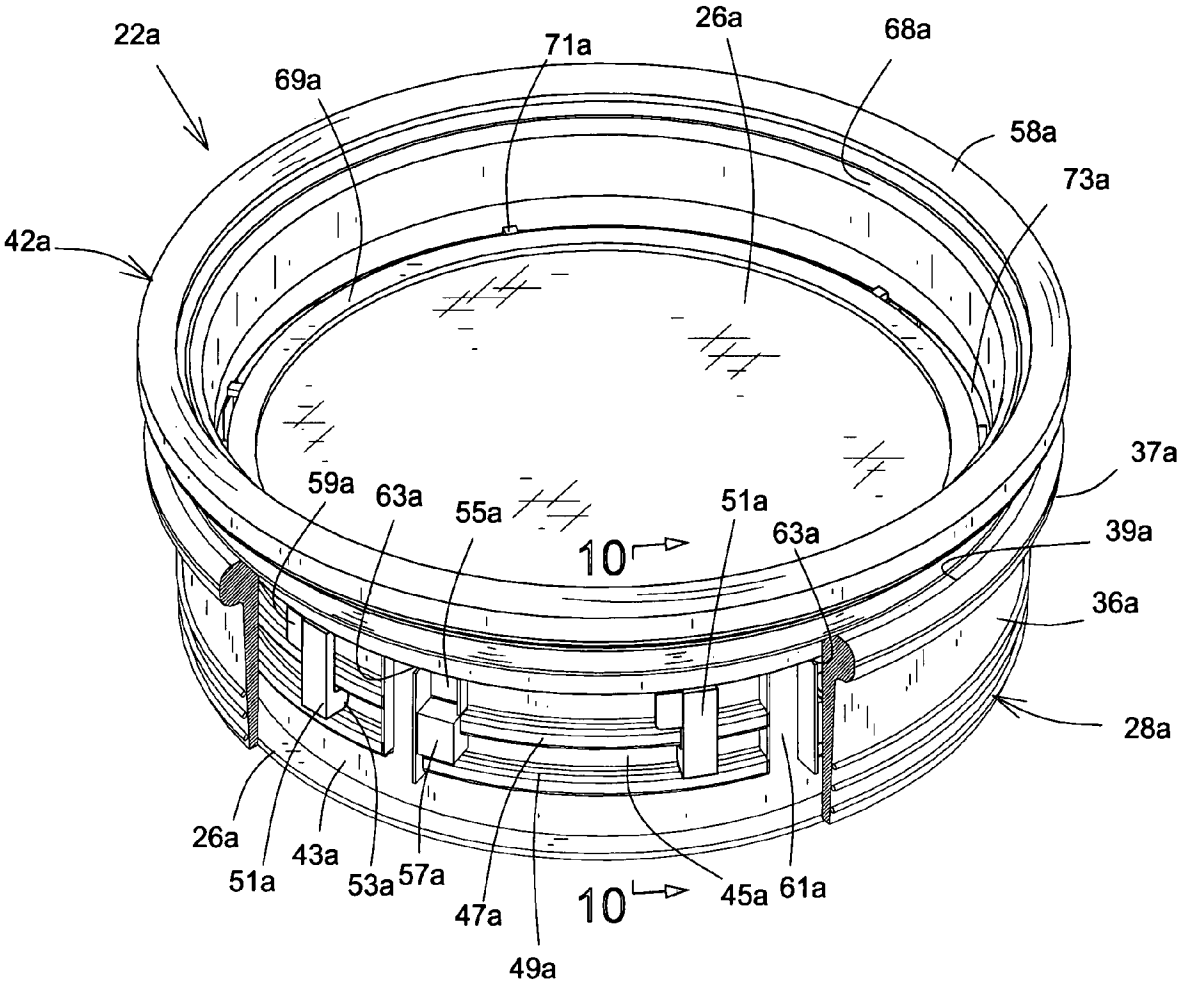
FIG. 8 is a perspective view of a cover for the container shown in FIG. 6 in a second configuration.
Figure 9:
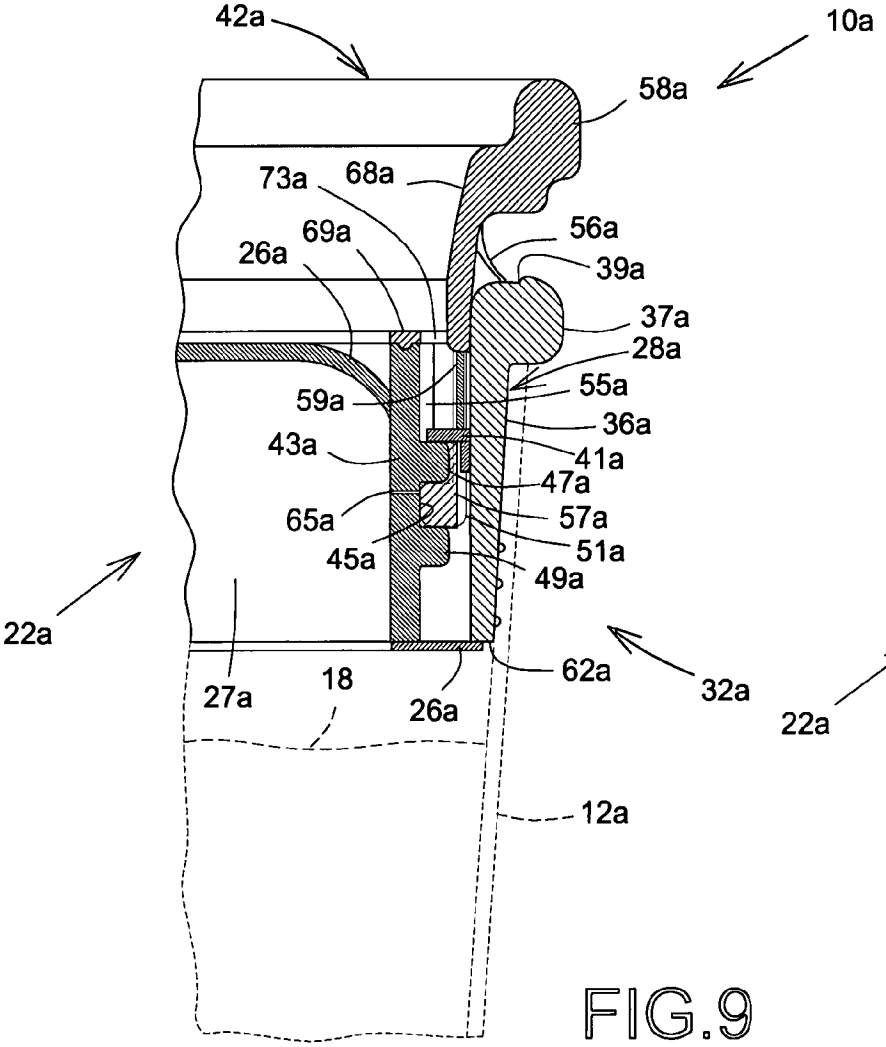
FIG. 9 is a sectional view of the container shown in FIG. 6, taken along line 9-9 of FIG. 7 and illustrating the first configuration shown in FIG. 7.

The cover 22*a* includes a locking mechanism to lock the cover into the first configuration 32*a* to keep the inner closing structure in abutment against the lower edge 62*a* and seal the cover aperture 44*a* and therefore prevent any liquid 18 from escaping the container 10*a*. Each finger lip 53*a* slidably engages a respective portion of the channel 45*a* between a locking position, as shown in FIGS. 7 and 9, with the cover in the first configuration 32*a*, and an unlocking position, as shown in FIGS. 8 and 10. The lower cover wall 36*a* includes a plurality of corresponding blocking tabs 41*a* extending radially inwardly therefrom, each finger lip 53*a* preferably having a corresponding blocking tab 41*a*. Each tab 41*a* being sized and shaped to engage a corresponding axially extending tab channel 55*a* formed into the lower wall 43*a* adjacent the upper ridge 47*a* and the locking position of the corresponding finger 51*a*. When in the locking position, the lip 53*a* of each finger 51*a* abuts a respective stop 57*a* in register with the tab channel 55*a*, such that a finger ear 59*a* extending circumferentially therefrom overlaps the corresponding blocking tab 41*a* sitting on the upper ridge 47*a*, therefore clamping the tab 41*a* between the ear 59*a* and the upper ridge 47*a* to impede any local downward displacement of the upper top wall 68*a* and the corresponding finger 51*a* relative to the lower cover wall 36*a*, as shown in FIGS. 7 and 9. A rounded lower external corner of the ear 59*a* easy the positioning of the latter above the corresponding blocking tab 41*a*, to account for a slight downward force being exerted onto the top outer lip 58*a* by the user when sliding the finger lip 53*a* along its portion of the channel 45*a*. When in the unlocking position is reached by the finger 51*a* along the channel 45*a*, the finger 51*a* is free to move downwardly relative to the lower cover wall 36*a* while the corresponding blocking tab 41*a* is free to slide upwardly into its respective tab channel 55*a*, as shown in FIGS. 8 and 10. In order to position all blocking tabs 41*a* into their respective tab channel 55*a*, a tab access slot 61*a* axially extends through the upper and lower ridges 47*a*, 49*a* that slidably receive the corresponding tab 41*a* there along. As seen in FIGS. 7 and 8, a tab opening 63*a* located in between each tab channel 55*a* and its corresponding access slot 61*a* proximal the top outer lip 58*a* allow the corresponding blocking tab 41*a* to access its tab channel 55*a* from the access slot 61*a*.

As shown in FIG. 9, a safety vent hole 65*a* typically extends radially through the lower wall 43*a* in register with the lip 53*a* of only one of the fingers 51*a* when in the locking position. In such a locking position, the lip 53*a* prevent any liquid 18 to flow there through when the cover is in the first configuration 32*a*, and when the inner closing structure 26*a* forms a cavity 27*a* circumferentially defined by the lower wall 43*a*. Upon sliding of the corresponding lip 53*a* away from the locking position, air, or any other similar fluid, is allowed to vent there through the hole 65*a* before a downwardly force is exerted on the cover 22*a* to move it away from its first configuration 32*a* and start separating the outer perimeter of the inner closing structure from the lower edge 62*a*, which is especially practical when a gas pressure built-up may have formed inside the container 10*a*, as when a relatively hot liquid 18 such as coffee fills the container 10*a*, and thus prevent hot 18 liquid from being ejected out of the container 10*a* and impinge on a user.

The number of fingers 51*a* is typically selected to ensure that the cover 22*a* is rigid enough that it would remain in the first configuration 32*a* when the fingers 51*a* are in the locking position, even when a downwardly force is being exerted in between two adjacent fingers 51*a*.

Figure 11:
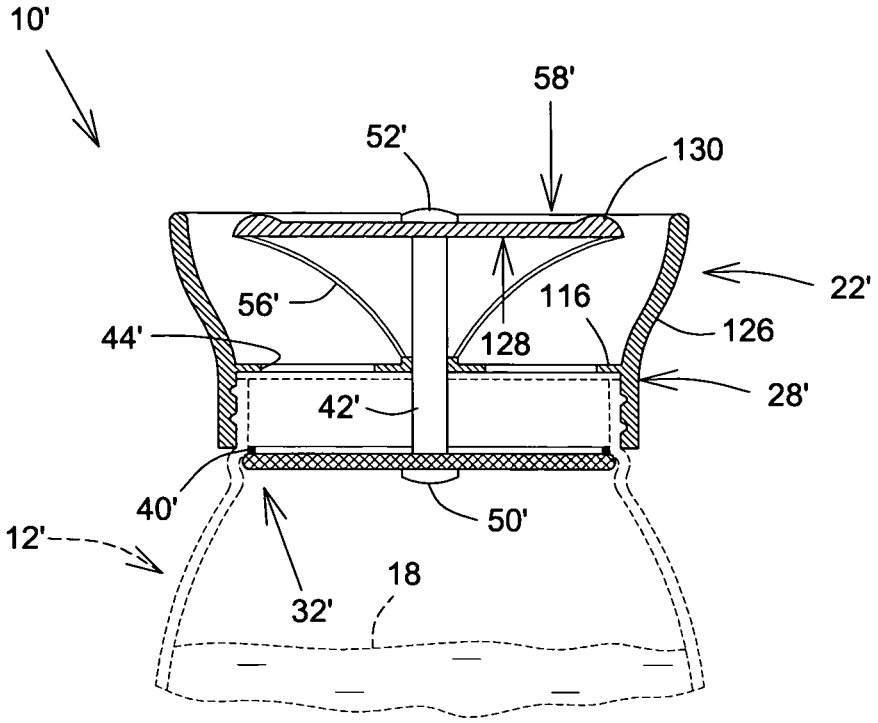
FIG. 11 is a perspective view of a liquid container in accordance with a third embodiment of the present invention and illustrating a first configuration therefor.
Figure 12:
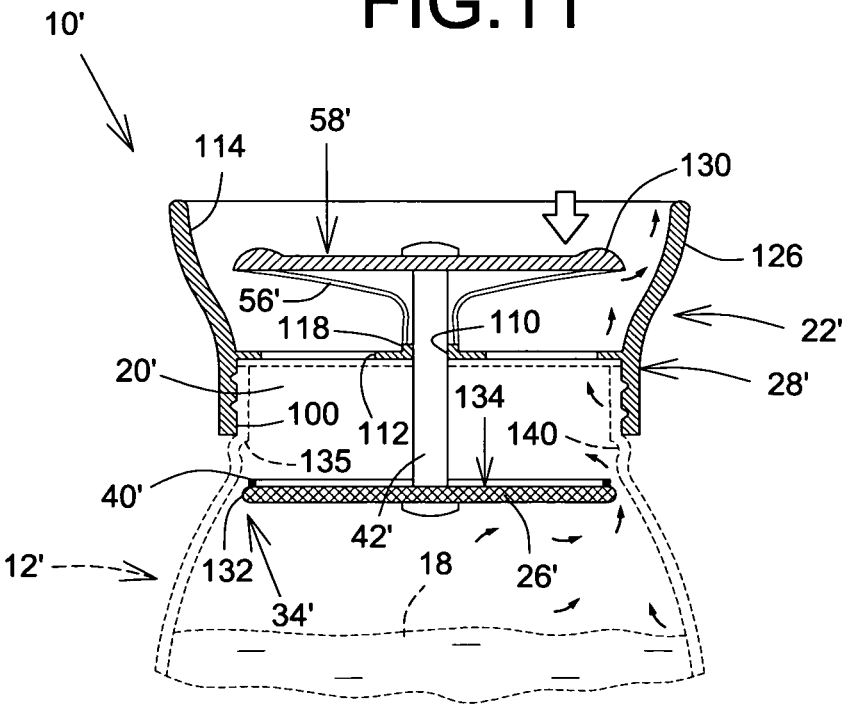
FIG. 12 is a perspective view of the container shown in FIG. 11 and illustrating a second configuration therefor.

Referring now to FIGS. 11 and 12, therein is shown a container 10' in accordance with a third embodiment of the present invention. As with the first embodiment, the container 10' has a body 12' and cover 22'. The body 12' has a body aperture 20' at the body top end 16' situated opposite a closed body bottom end 14'. The cover 22' is removably connected to the body 12' via a fixed cover member 28'. Specifically, the fixed cover member 28' preferably has a threaded inner portion 100 on an inner cover wall 104 situated proximal a bottom cover end 102. The inner threaded portion 100 is configured for removable and sealingly screwing onto an outer threaded portion 106 of the body 12' proximal the body top end 16'. A radially inwardly protruding cover lip 116, which protrudes inwardly from the inner cover wall surface 114 on a cover wall 126 of the fixed member 28' and extends therearound, abuts preferably sealingly against the body top end 16'.

The cover 22' has a mobile member 42' with an inner closing structure 26' disposed on a first member end 50' thereof and a top 58' disposed on a second member end 52' thereof, with upper cover walls 126 extending above the cover lip 116 upwardly beyond the top 58', typically to prevent accidental displacement of the mobile member 42' away from the cover first configuration 32' upon falling of the container 10'. The top 58' is further sized and shaped such that the upper top edges 130 thereof are spaced apart from the inner side wall surface 114 of the upper cover wall 126, thus providing a space through which the liquid 18 may flow from the body aperture 20' through the cover aperture 44' and out of the cover 22' to enable removal of the liquid 18 from the container 10'. The member 42' is connected generally to a central portion of the top 58' and a central portion of the inner closing structure 26' and is resiliently mounted in the cover 22' by at least one resilient outer membrane 56'. Preferably, and as shown, the member 42' is axially slidably mounted in a fixed member aperture 110 situated in a central portion 118 of at least one extending arm 112 extending diametrically across the cover aperture 44' between opposing portions of the cover lip 116, with a plurality of equally spaced apart outer membranes 56' extending from the arm 112 to the lower side 128 of the top 58', typically adjacent the periphery thereof. Preferably there are between two and four outer membranes 56' circumferentially, and preferably equally, spaced apart from one another.

The inner closing structure 26' is configured, i.e. sized and shaped, for extension across the body aperture 20' with the membrane edge 132, and in particular an upper membrane side 134, sealingly abutting against a ridge 135 of a recess 140 in the inner body wall 38' situated proximally below and adjacent the threaded inner portion 100 thereof. Optionally, yet preferably, a sealing ring 40' is disposed on the upper side 134 of the closing structure 26' proximal to or at the membrane edge 132 and sealingly abuts the ridge 135. When the cover 22' is in a first configuration 32' shown in FIG. 11, the inner closing structure 26' is resiliently biased, by the action of the outer membranes 56' on the top 58' and member 42', towards the ridge 135 such that the sealing membrane 56' extends completely across the body aperture 20' with the upper side 134, and sealing ring 40' if present, abutting against the ridge 135. Thus, in the first configuration 32', the inner closing structure 26' covers and seals the aperture 20', and prevents liquid 18 from being removed from the container 10'. The cover 22' is placed in the second configuration 34', shown in FIG. 12, by application of a downwardly directed force, shown by the large arrow, on the top 58'. The downwardly directed force causes the inner closing structure 26' to separate from the ridge 135, creating a space between the closing structure 26' and the inner body wall 38' through which the liquid 18 may pass freely into the body aperture 20' and out through the cover aperture 44'. Thus, the liquid 18' may flow freely through apertures 20', 44' when the cover 20' is in the second configuration 34', allowing release of the liquid 18' for drinking. As the top 58', member 42' and inner closing structure 26' are centrally situated and the outer membranes 56' are substantially equally spaced apart, the cover 20' may be placed in the second configuration 34' by applying sufficient downwardly directed force to any portion of the top 58', such as via the upper lip or nose of a user. Thus, conveniently, the user, such as a young child, may press any portion of the top 58' to release the liquid 18.

Figure 13:
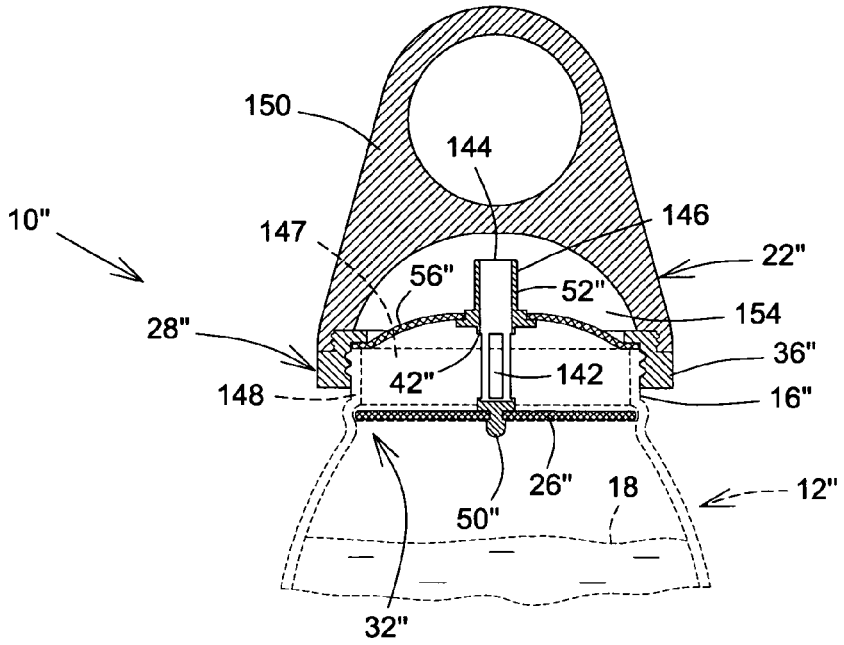
FIG. 13 is a perspective view of a liquid container in accordance with a fourth embodiment of the present invention and illustrating a first configuration therefor.
Figure 14:
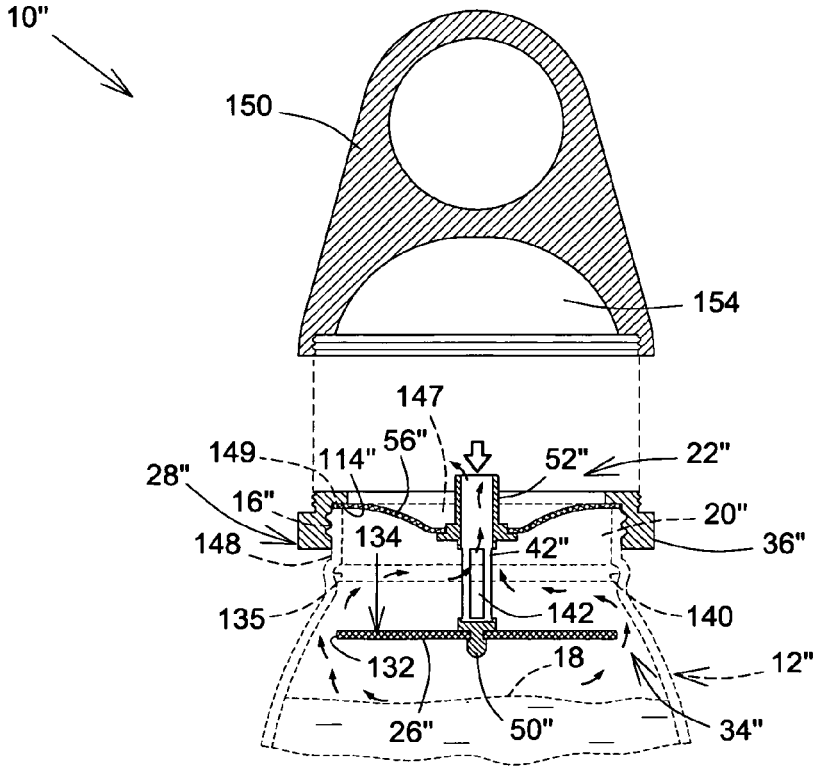
FIG. 14 is a perspective view of the container shown in FIG. 13 and illustrating a second configuration therefor.

Referring now to FIGS. 13 and 14, therein is shown a fourth embodiment of the container 10" of the present invention. The container 10" has a cover 22" mounted in and across the body aperture 20", again situated at the body top end 16" opposite the closed body bottom end, not shown. Specifically, the cover 22" has a resilient inner closing structure 26" connected to a closed first member end 50" of a hollow mobile member 42" connected proximal a second, open member end 52" thereof to a resilient outer membrane 56", with the second end 52" extending slightly beyond the outer membrane 56". The member 42" further has at least one intermediate member aperture 142 disposed between the membrane 56" and the closing structure 26" and an end aperture 144 situated at the second end 52". Thus, liquid 18 may flow from the member aperture 142 through the member 42" and out of the end aperture 144, the second end 52" being sealingly mounted through the outer membrane 56" with a mounting tube 146 which prevents passage of the liquid out of the second end 52" except for the end aperture 144.

The outer membrane 56" is configured to extend completely across the neck 147 of the body aperture 20" at the top body end 16" with the outer membrane 56" sealingly laying across the outer wall 148, notably the wall edge 149, at the body top end 16", preferably sealingly connected thereto and maintained at its location by an axially inwardly protruding lip 114" of the fixed cover member 28" secured to the top end 16" via the cover walls 36" connected thereto, preferably via threads or the like. Further, the fixed member 28" preferably sealingly engages the outer threaded portion 152 of the body 12" when attached thereto. The inner closing structure 26" is configured, for example sized and shaped, such that, when the cover 22" is in a first configuration 32" shown in FIG. 13, the sealing closing structure 26" is biased by the outer membrane 56" towards the top end 16" such that the inner closing structure 26" extends sealingly across the body aperture 20" within the body 12", with the membrane edges 132 sealingly disposed in recess 140 and the upper membrane side 134 sealingly abutting against ridge 135. Accordingly, in the first configuration 32", the inner closing structure 26" seals the body aperture 20" within the neck 147 of the body 12" at the height of the ridge 135 and prevents the liquid 18 from passing beyond the ridge 135 and recess 140, thus preventing release of the liquid 18 from the container 10". At the same time, the resilient action of the sealing closing structure 26" also pulls the outer membrane 56" towards the first end 14" when the cover 22" is in the first configuration 32", thus reinforcing the sealing of the top body end 16".

Referring now to FIG. 14, by application of a downwardly directed force, shown by the large arrow, to the member 42", for example by a users finger or lips, the cover 22" is placed in the second configuration 34" in which the inner closing structure 26" connected thereto is separated from the ridge 135 and recess 140. Accordingly, in the second configuration 34" the liquid 18 may flow past the sealing closing structure 26" and into the member aperture 142, through the member 42" and out of the end aperture 144 for removal from the container 10". Once again, removal of the downwardly directed force causes the outer membrane 56" to bias the cover 22" back into the first configuration 32", which seals the body aperture 20" and prevents liquid 18 from being released.

Optionally, a cap 150 removably mounted on the fixed cover member 28" may be provided with the cover 22". As shown the cap 150 is preferably snappingly connected onto the fixed member 28" for convenient and easy removal therefrom and attachment thereonto. The cap 150 has an inner recessed portion 154 which is configured, for example, sized and shaped, for housing the member 42" therein without contact of the member 42" with the cap 150 when the cap 150 is attached to the fixed member 28" and the cover 22" is in the first configuration 32". Thus, when the cap 150 is attached, the cap 150 does not exert a downward force on the member 42" and place the cover 22" in the second configuration 34". The cap 150 typically sealably mounts onto the fixed cover member 28" to prevent escape of the liquid 18 should movement of the container 10" somehow exert sufficient force downward force to place the cover 22" in the second configuration 34".

Figure 15:
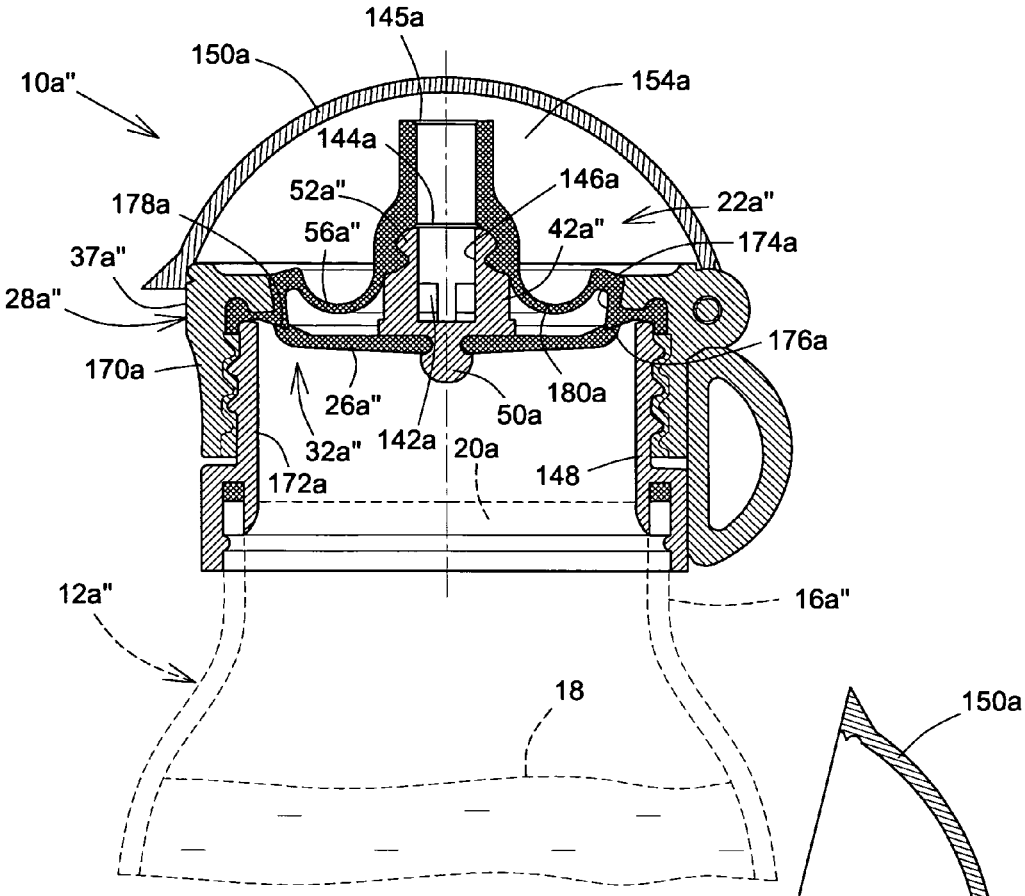
FIG. 15 is a perspective view of a liquid container in accordance with a fifth embodiment of the present invention and illustrating a first configuration therefor.
Figure 16:
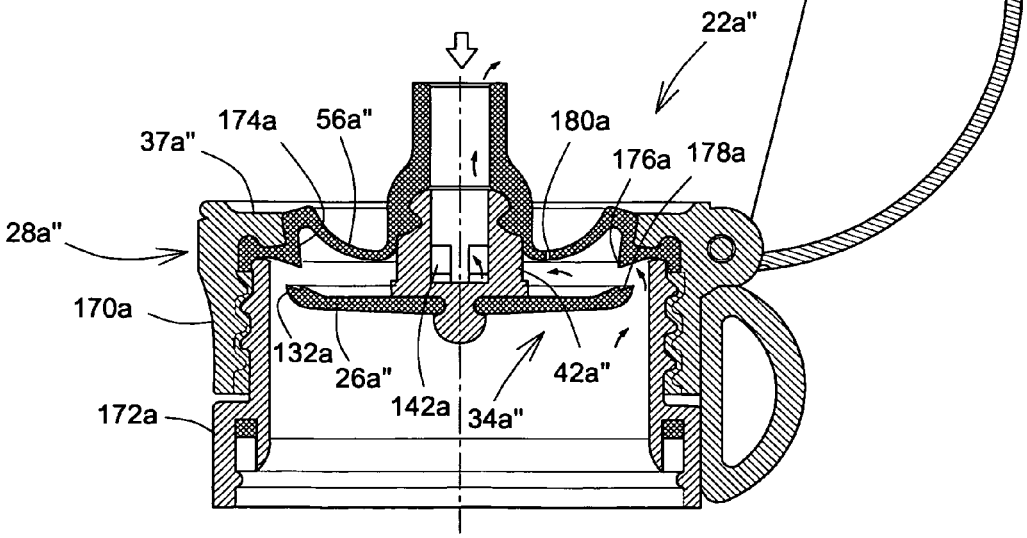
FIG. 16 is a perspective view of the container shown in FIG. 15 and illustrating a second configuration therefor.

Referring now to FIGS. 15 and 16, therein is shown a fifth embodiment of the container **10*a*" of the present invention. The container 10*a*" has a cover 22*a*", similar to the cover 22" of the fourth embodiment, mounted in and across the body aperture 20*a*", again situated at the body top end 16*a*" opposite the closed body bottom end (not shown). Specifically, the cover 22*a*" has a resilient inner closing structure 26*a*" connected to a closed first member end 50*a*" of a hollow mobile member 42*a*" connected proximal a second, open member end 52*a*" thereof to a resilient outer membrane 56*a*", with the second end 52*a*" extending slightly beyond the outer membrane 56*a*". The member 42*a*" further has at least one intermediate member aperture 142*a* disposed between the membrane 56*a*" and the inner closing structure 26*a*" and an end aperture situated at the second end 52*a*" sealingly mounted through the outer membrane 56*a*" with a mounting tube 146*a* which prevent passage of the liquid 18 out of the second end 52*a*" except for the end aperture 144*a***.

The inner perimeter of the outer membrane **56*a*" surrounds the top end 52*a*" and extend axially upwardly therefrom above the mounting tube 146*a* to form a flexible tube end aperture 145*a*. The outer perimeter of the membrane 56*a*" connects to the fixed cover member 28*a*" and is sealingly clamped between an upper section 170*a* thereof typically threadably engaging a lower section 172*a* thereof. The lower section 172*a* is typically snappingly and sealingly connected to the body top end 16*a*"**, although other type of attachment could be considered without departing from the scope of the present invention.

The outer perimeter of the outer membrane **56*a*" forms an inwardly and downwardly extending shoulder 174*a*, preferably having a relatively sharp outer corner 176*a*, assuming the shape of the inner portion of a cover lip 37*a*". The outer perimeter 132*a* of the inner closing structure 26*a*" typically has a corresponding relatively sharp upper inner channel 178*a* to sealingly abut and receive the corner 176*a* of the shoulder 174*a* of the membrane 56*a*" when in the first configuration 32*a*" of the cover 22*a*", as shown in FIG. 15. Upon a user exerting a downwardly directed force, shown by large arrow in FIG. 16, to the member 42*a*", the cover 22*a*" is placed in the second configuration 34*a*" in which the inner closing structure 26*a*" connected thereto is separated from the outer corner 176*a* to allow for the liquid 18 to flow out past the sealing closing structure 26*a*" and into the member aperture 142*a*, through the member 42*a*" and out at the end aperture 145*a* for removal from the container 10*a*". Removal of the downwardly directed force, once again, causes the resilient outer membrane 56*a*" to bias the cover 22*a*" back into the first configuration 32*a*", which seals the body aperture 20*a*" and prevents liquid 18** from being released.

Optionally, a cap **150*a* pivotally mounted onto the fixed cover member 28*a*" may be provided with the cover 22*a*". The cap 150*a* has an inner recessed portion 154*a* which is configured, sized and shaped for housing the mobile member 42*a*" therein without contact of the member 42*a*" with the cap 150*a* when the cap 150*a* is closed onto the fixed member 28*a*" and the cover 22*a*" is in the first configuration 32*a*", thus preventing the member 42*a*" from being hit and therefore preventing escape of liquid 18**.

In order to allow a user to continuously have liquid coming out of the container **10*a*" through the cover 22*a*" when in the second configuration 34*a*", a small air vent hole 180*a* typically extends through the outer membrane 56*a*". Because of its location of the membrane 56*a*", the vent hole 180*a* is typically closed off when the cover 22*a*" is in the first configuration 32*a*" and gets opened when the cover 22*a*" is in the second configuration 34*a*", as shown in FIGS. 15 and 16, respectively, to allow air to get into container 10*a*" to fill in the volume of liquid 18 escaping the container 10*a*" via the cover 22*a*"**.

For all embodiments, the body 12, **12*a*, 12', 12", 12*a*" is constricted of a solid impermeable material impermeable to the liquid, for example glass or a solid plastic, as is the cap 150. The cover 22, 22*a*, 22', 22", 22*a*" is also constructed of a solid impermeable material, with the exception of the sealing rings 40 and membranes 26, 26*a*, 26', 26", 26*a*", 56, 56*a*, 56', 56", 56*a*". The membranes 26, 26*a*, 26', 26", 26*a*", 56, 56*a*, 56', 56", 56*a*" are also made of material that is impermeable to the liquid, but which is resiliently flexible such as to permit biasing between the first and second configurations shown. For example, the membranes 26, 26*a*, 26', 26", 26*a*", 56, 56*a*, 56', 56", 56*a*" may be made of flexible and resilient plastics, rubber, or the like. Sealing rings 136 and seal may be made of any impermeable material suitable for membranes 26, 26*a*, 26', 26", 26*a*", 56, 56*a*, 56', 56", 56*a*"** including rubber, plastic, or the like.

Although the present container and its cover have been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A cover for a liquid container having a body for holding a liquid and defining a body aperture, said cover comprising:

a rigid mobile member connecting all around to a rigid fixed member via a resilient membrane connected thereto, the fixed member being removably mountable on the body adjacent the body aperture and having a lower edge;

an inner closing structure mountable proximal the body aperture and fixedly connected to the mobile member, the inner closing structure, by a local application of an inwardly directed force over only a portion of the mobile member, being locally movable from a first configuration for the cover, in which the inner closing structure impedes passage of the liquid through the body aperture, into a second configuration in which a portion of the body aperture is unblocked with a portion of the inner closing structure moving away from the lower edge and the liquid may flow therearound and out of the body aperture for removal from the container, while a remaining portion of the inner closing structure remains into the first configuration, the inner closing structure being spaced from the resilient membrane along the mobile member and being adapted to be inwardly positioned toward the liquid container relative to the resilient membrane with the resilient membrane connecting to the mobile member at a location between the inner closing structure and the mobile member on which the inwardly directed force is applied, the resilient membrane allowing local inward displacement of the portion of the mobile member relative to the fixed member upon the local application of the inwardly directed force and biasing the inner closing structure and the mobile member into the first configuration for the cover.

2. The cover of claim 1, wherein the resilient membrane connects to the mobile member and to the fixed member, and extends therebetween for local axial movement of the portion of the mobile member relative to the fixed member.

3. The cover of claim 1, further including a locking mechanism to selectively and rotatably lock the cover into the first configuration and prevent displacement of the mobile member relative to the fixed member, the locking mechanism connecting to both the mobile member and the fixed member.

4. The cover of claim 3, wherein:

the fixed member is frictionally engageable within the body aperture and the mobile member is insertable within the fixed member and attached to the inner closing structure;

the inner closing structure includes a lower wall extending radially therefrom, a circumferential channel being formed within said lower wall;

relatively upper and lower parallel ridges extend outwardly and circumferentially of the lower wall defining the channel;

a plurality of fingers is provided with finger lips for slidable engagement within the channel, the fingers depending axially from an upper top wall of the mobile member;

the upper top wall is rotatable in use relative to the lower wall and has an inner ring adapted to sit on the lower wall being spaced therefrom through the agency of a plurality of circumferentially spaced ring connectors defining circumferential openings therebetween.

5. The cover of claim 4, wherein the lower wall and the ridges forming the channel are radially inwardly spaced from a lower cover wall of the fixed member and also from the upper top wall of the inner closing structure, whereby in use when the cover is in the second configuration liquid flow can occur through the space, between the fingers and through the circumferential openings and thence outwardly therefrom.

6. The cover of claim 5, further including a top outer lip provided on the upper wall and protrudes radially outwardly therefrom, a cover lip is provided atop the fixed member, and the resilient membrane depends from the outer lip and contacts the cover lip.

7. The cover of claim 6, wherein the cover lip includes a step formed therein, said step being adapted in use to receive and constrain the resilient membrane when the cover is in the second configuration.

8. The cover of claim 7, wherein the lower wall of the inner closing structure is provided with an axially extending tab channel adjacent the relatively upper ridges, the tabs of the locking mechanism being associated with the finger lips of the fingers on the mobile member and each tab being dimensioned for engagement with said tab channel.

9. The cover of claim 8, further including stops provided in the tab channel, the lip of each finger being adapted to abut said stop in register with tab channel to lock the cover in the first configuration.

10. The cover of claim 9, further including a safety vent hole is provided in the lower wall of the inner closing structure in register with a lip of one of the fingers when in the locking mode.

11. A cover for a liquid container having a body for holding a liquid and defining a body aperture, the cover comprising:

a cover body comprising means for retaining the cover onto the container and a rigid fixed cover member defining cover aperture with circumferential openings, the fixed cover member having a bottom peripheral surface defining a lower edge;

a rigid mobile member having only a portion on which a user can locally apply pressure;

an inner closing structure fixedly connecting to the mobile member, a portion of the inner closing structure being locally movable from a first configuration wherein the cover aperture is closed to prevent discharge of the liquid contained in the container through the circumferential openings to a second configuration wherein the cover aperture is locally open to allow discharge of the liquid through the circumferential openings, while a remaining portion of the inner closing structure remains in the first configuration; and a resilient membrane mounted on the mobile member and defining a diaphragm between the fixed cover member and the mobile member, the mobile member being responsive to the pressure of the user such that the inner closing structure is locally movable from the first configuration, wherein the inner closing structure abuts against the lower edge for impeding passage of the liquid through the cover aperture and the resilient membrane biases the inner closing structure against the cover aperture when the pressure is no longer applied on the portion of the mobile member, to the second configuration, wherein the resilient membrane allows local displacement of a portion of the inner closing structure relative to the lower edge upon local application of the pressure on the portion of the mobile member and the portion of the inner closing structure no longer abuts against the lower edge for locally allowing passage of the liquid in the cover aperture.

12. The cover of claim 11, further comprising a locking mechanism having an actuator that is rotatable between a first position, wherein the inner closing structure is movable between the first and second configurations, and a second position, wherein the inner closing structure is locked and movement of the inner closing structure is prevented when pressure is applied on the mobile member.

13. The cover of claim 11, wherein the cover body, mobile member and inner closing structure comprise a central longitudinal axis and wherein the inner closing structure moves in translation between the first and second configurations when the user applies pressure along the central longitudinal axis.

14. A cover for a liquid container having a body for holding a liquid and defining a body aperture, the cover comprising:

a cover body comprising means for retaining the cover onto the container and a rigid fixed cover member comprising (i) a cover aperture with circumferential openings and (ii) a bottom peripheral surface defining a lower edge;

a rigid mobile member having only a portion on which a user can locally apply pressure;

an inner closing structure fixedly connected to the mobile member, a portion of the inner closing structure being locally movable from a first configuration wherein the cover aperture is closed to prevent discharge of the liquid contained in the container through the circumferential openings to a second configuration wherein the cover aperture is locally open to allow discharge of the liquid through the circumferential openings, while a remaining portion of the inner closing structure remains in the first configuration; and a resilient membrane mounted on the mobile member and defining a diaphragm between the fixed cover member and the mobile member;

wherein the mobile member is responsive to the pressure of the user such that the portion of the inner closing structure is movable from the first configuration, in which the inner closing structure abuts against the lower edge for impeding passage of the liquid through the cover aperture and the resilient membrane biases the inner closing structure against the lower edge when the pressure is no longer applied on the portion of the mobile member, to the second configuration, in which the resilient membrane allows local displacement of the portion of the inner closing structure relative to the lower edge upon local application of the pressure on the portion on the mobile member and the portion of the inner closing structure no longer abuts against the lower edge for locally allowing passage of the liquid in the cover aperture.

15. The cover of claim 14, further comprising a locking mechanism having an actuator that is rotatable between a first position, wherein the inner closing structure is movable between the first and second configurations, and a second position, wherein the inner closing structure is locked and movement of the inner closing structure is prevented when pressure is applied on the mobile member.

* * * * *